United States Patent [19]

Lauritsen et al.

[11] 4,456,801

[45] Jun. 26, 1984

[54] PRESSURE SWITCH

[75] Inventors: Richard L. Lauritsen, Hoffman Estates; David W. Kozerski, Cicero, both of Ill.

[73] Assignee: The Singer Company, Stamford, Conn.

[21] Appl. No.: 355,630

[22] Filed: Mar. 8, 1982

[51] Int. Cl.[3] ..... H01H 35/34

[52] U.S. Cl. ..... 200/83 P; 200/83 S

[58] Field of Search ..... 200/83 R, 83 B, 83 N, 200/83 P, 83 S, 83 SA, 83 T, 83 W

[56] References Cited

U.S. PATENT DOCUMENTS

| | | | |
|---|---|---|---|
| 2,919,321 | 12/1959 | Lung | 200/83 P |
| 3,465,112 | 9/1969 | Reichert et al. | 200/83 B |
| 4,297,552 | 10/1981 | Lauritsen et al. | 200/83 P |
| 4,330,695 | 5/1982 | Poling | 200/83 P |

*Primary Examiner*—J. R. Scott

*Attorney, Agent, or Firm*—David L. Davis; Robert E. Smith; Edward L. Bell

[57] ABSTRACT

Increasing pressure acting under the thin plastic film diaphragm will move the actuator upward against the force of the outer reset spring until the upper inside washer/seat engages the outer washer/seat causing the inner trip spring to be compressed with further upward movement. Thereafter, switch actuation is opposed by both springs and the trip force is determined by both springs. As pressure decreases after the switch has tripped, the inside spring seat engages the shoulder on the actuator so only the reset spring is effective to determine the reset force. Both springs are assembled on the actuator prior to assembly in the pressure switch. The terminal structure is novel in the way it is positively located and accurately locates the switch.

7 Claims, 5 Drawing Figures

PRESSURE SWITCH

TECHNICAL FIELD

A pressure responsive switch for use in automotive air conditioning systems.

BACKGROUND ART

To improve fuel economy automotive air conditioners have been provided with a clutch to avoid running the compressor when further cooling is not desired. Clutch operation has been controlled by thermostatic or pressure responsive switches with the pressure switch generally being used only with flooded evaporator systems.

Pressure switches used in the past use a single spring for determining the trip and reset points and require calibration. They make contact slowly and a snap-disc is used to make and maintain positive electrical contact. Small chips can break off and fall into the contact area as the calibration screw is turned against the plastic housing. The chips contaminate the contacts and impair function and service life. The snap-disc introduces variation into the calibrated setting.

DISCLOSURE OF THE INVENTION

The principle object of this invention is to provide a pressure switch which is small, rugged and requires no calibration after manufacture. To avoid the need for calibration this design employs a dual compression spring concept in which the trip point is determined by the combined force of two low-rate springs while the reset point is determined by the force of only one of the springs. The dual spring concept is not per se new, having been shown in U.S. Pat. No. 3,230,328. That design, however, required adjustability of the trip and reset points and resulted in an assembly which was difficult to produce. The present design employs dual compression springs mounted on a plunger in such a way as to result in a unitary subassembly which is easily fabricated and handled during the subsequent assembly into the pressure switch. This greatly simplifies the assembly of the pressure switch and brings about an appreciable cost reduction. The design arrangement is such that the requisite large pressure differentials of trip and reset can be obtained with low rate springs which permit fabrication with precise, accurate switching points without need for calibration of the final assembly.

In order to attain accurate trip points it is necessary to employ a diaphragm which has a consistent effective area from diaphragm to diaphragm and the diaphragm must be substantially impermeable to Freon-12 and the oil entrained in the Freon in the refrigeration system. Furthermore, the diaphragm must not exert forces of its own since such forces become a further variable in the system. Hydrin and Buna-N diaphragm materials tested were permeable to Freon and oil when made sufficiently thin to meet the other requirements of the diaphragm. Tests indicated the rolling diaphragm in which folds are molded into the diaphragm is unsatisfactory as detracting from the desired consistent effective area of the diaphragm as well as having excessive permeability. We have found polyimide plastic film material can serve this purpose if it is cold formed generally to the shape the diaphragm would assume at either end of the plunger stroke.

The present pressure switch must, of necessity, be quite small in scale. Assembling such a pressure switch can be difficult. The spring subassembly simplifies assembly of the pressure switch. Furthermore, the present design incorporates a terminal arrangement which greatly simplifies assembly while insuring accurate location of the switch blade and terminals to maintain accuracy of calibration.

DETAILED DESCRIPTION OF THE DRAWINGS

Figure 1:
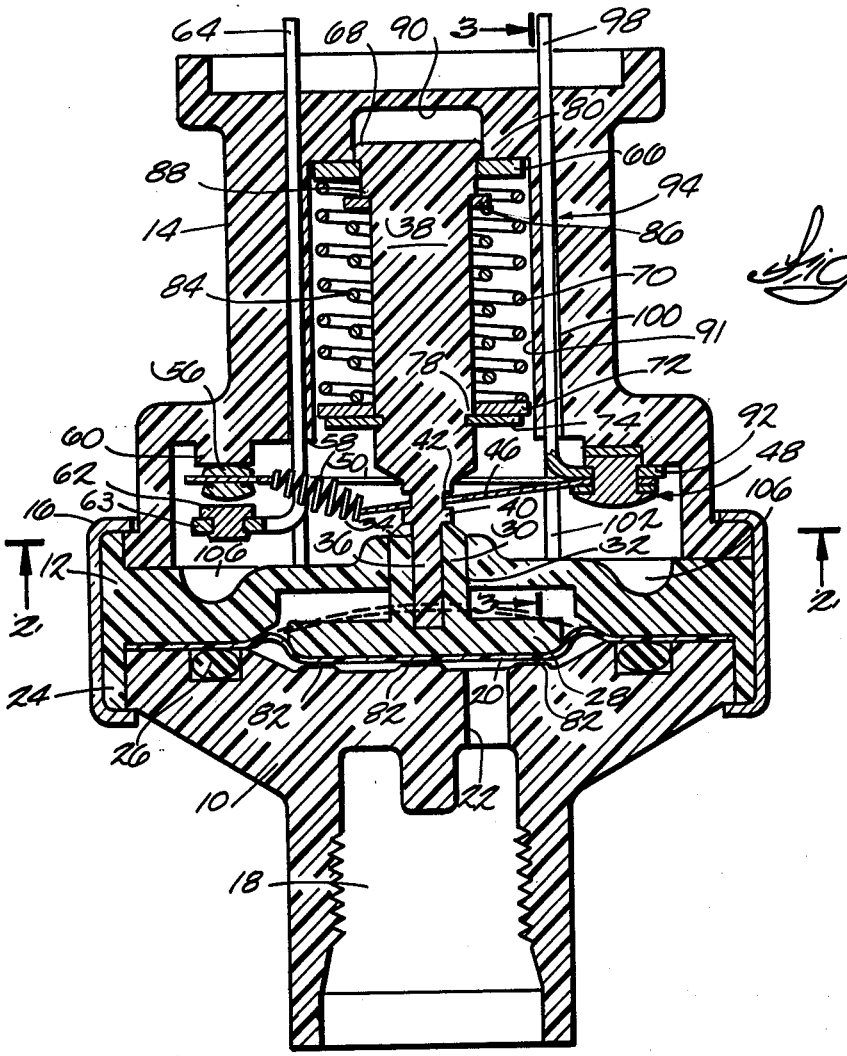
FIG. 1 is a vertical section through the pressure switch.
Figure 2:
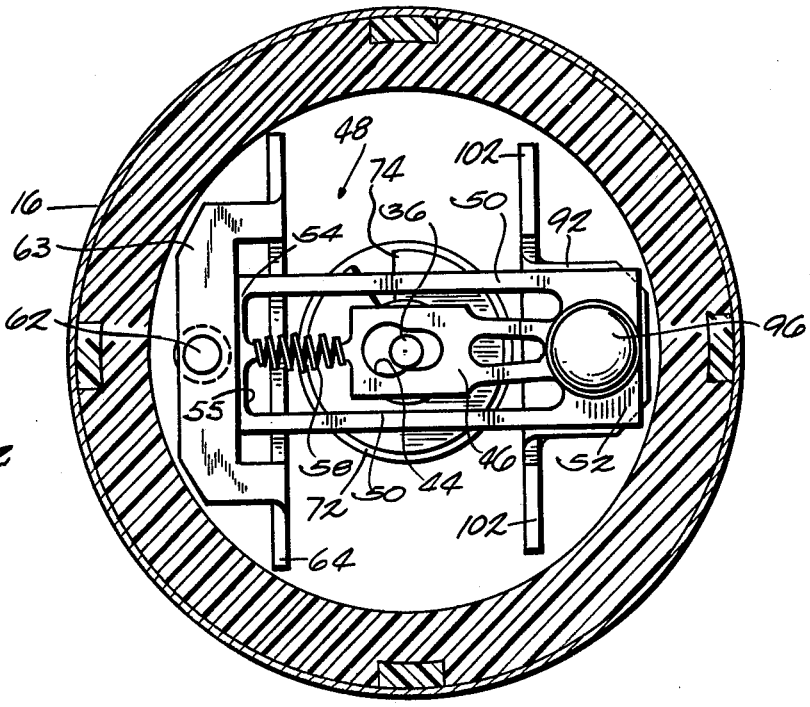
FIG. 2 is a horizontal section through FIG. 1 on Line 2—2.

The pressure switch housing is made up of lower, intermediate and upper plastic parts 10, 12 and 14 held together by the circular clamp ring 16 crimped over the shoulders of the upper and lower parts. The intermediate part 12 forms a partition in the housing and serves to guide and limit motion of the diaphragm pad and to locate the terminals and switch. The lower housing 10 has an inlet 18 threaded for connection to the air conditioning system, usually at a point at or near the evaporator outlet. The Freon refrigerant in the system exerts pressure at the inlet and this pressure is transmitted to the space below diaphragm 20 through conduit 22. Diaphragm 20 is a thin polyimide film which is cold formed (as may be seen in dotted lines in FIG. 1 and in perspective in FIG. 4) to be slightly domed so that it assumes the position shown in FIG. 1, and when fully extended upwardly will have substantially the same shape but extends in the other direction. The polyimide film circumference abuts the inside of the locating lugs 24 of the intermediate housing member. The intermediate housing member clamps the film in place with the O-ring 26 sealing against the film to prevent leakage from the pressure chamber underneath the diaphragm. It has been found that the polyimide film is substantially impervious to Freon and oil entrained in the Freon. The cold formed shape of the film does not impose any forces which could adversely affect the trip and reset points of the pressure switch. The film does not stretch or wrinkle in use to any significant extent. Therefore, the area of the film is considered constant and does not introduce a variable into the calculated performance of the pressure switch.

The diaphragm pad 28 resting on top of the diaphragm has a central boss 30 extending through and guided by the central hole 32 in the intermediate housing member. The boss has a central bore 34 receiving the lower end 36 of actuator 38. The collar 40 immediately above the lower end 36 of the actuator rests against the upper end of the boss 30. The actuator is provided with a groove or reduced diameter section 42 which engages the narrow portion of the key slot 44 in the actuating tongue 46 of the switch 48. The switch has a blade having side rails 50, 50 extending from the fixed end 52 of the switch to the contact carrying end 54. The contact carrying end includes a cross member 55 to which the switch contact 56 is secured. Barrel spring 58 is compressed between the contact carrying end 54 and the actuating tongue 46 and biases the blade up or down and drives the blade from one position to the other with a snap action as the force component of the spring goes over center. In moving between the position shown in FIG. 1 in which the contact 56 engages pad 60 molded in the upper housing part and a lower position in which it engages contact 62 fixed on the bent support portion 63 of the formed terminal 64 there is considerable freedom of movement of the switch tongue relative to the groove 42. This insures good snap action when the blade goes over center and avoids overstressing the switch.

The head or upper end of the actuator 38 is received in and guided by the upper reduced diameter portion 90 of the guide tube or tubular recess 91 in the upper housing. Actuator 38 is provided with a washer 66 bearing against the underside of head 68 by reason of compression of spring 70 between the washer 66 and a lower washer 72 loosely fitted over the actuator 38 and retained in position by means of the E-type retaining ring 74 engaging groove 78 in the actuator. Both washers serve as spring seats with the lower seat 72 being, in effect, fixed. In the position shown in FIG. 1, spring 70 is bearing against internal shoulder or stop 80 and fixed washer 72 forcing the actuator down to the extent permitted by engagement of collar 40 with the upper end of the boss 30 of the diaphragm pad which is pressed against the lands or pads 82 in the chamber under the diaphragm. Thus, spring 70 urges the actuator 38 downwardly in FIG. 1. In FIG. 1 washer 66 also seats against head 68 so the force of spring 70 may be cancelled until the first small movement of the pad and actuator.

Trip spring 84 is compressed between the fixed seat 72 and a washer/seat 86 bearing against the shoulder 88 at the upper end of the actuator. Seat 86 has a larger outside diameter than the inside diameter of seat 66 and will, therefore, engage seat 66 as the actuator is moved upwardly by reason of increasing pressure underneath the diaphragm. Thus, as the pressure increases under the diaphragm the reset spring 70 is compressed while the actuator pin 38 rises. When the actuator has advanced approximately ½ of its total available stroke seat 86 will engage seat 66. Now trip spring 84 is being compressed along with the reset spring 70. After an additional ¼ stroke, the tongue of the switch will be at the point where the barrel spring goes over center and snaps the switch contact down to engage contact 62. The actuator can rise another ¼ of the total stroke before the diaphragm pad 28 engages the underside of the intermediate member and prevents further upward movement of the actuator. At this time the actuator will almost contact the top of the recess or guide tube.

Figure 4:
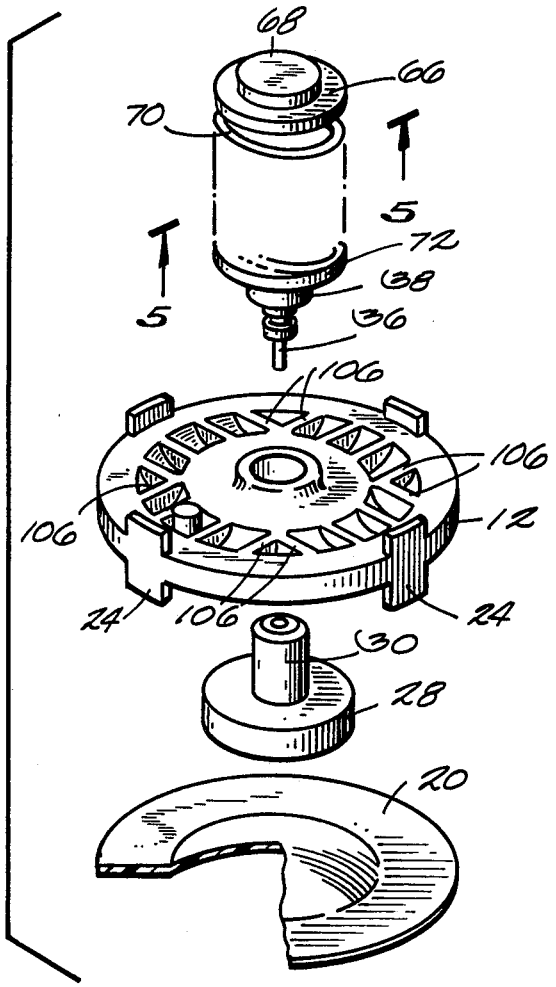
FIG. 4 is an exploded perspective view showing the spring subassembly, the intermediate plastic member, the diaphragm, and the diaphragm pad with the diaphragm being shown partly broken away to show the cold formed shape thereof.
Figure 5:
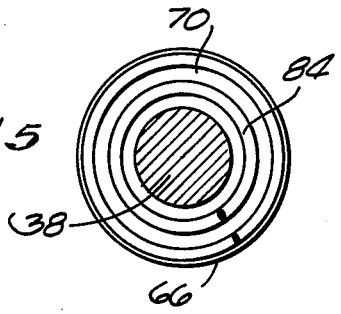
FIG. 5 is a section through the spring assembly taken on Line 5—5 in FIG. 4.
Figure 3:
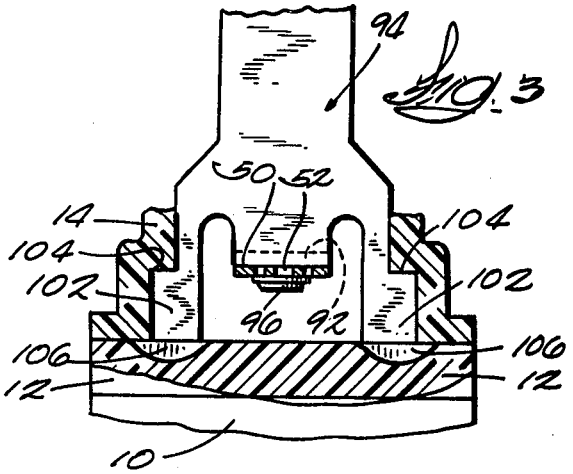
FIG. 3 is a fragmentary section taken on Line 3—3 in FIG. 1.

As can be seen in FIG. 4, the spring assembly is a complete subassembly which can be assembled outside before assembling it into the upper housing 14. The two springs are assembled between seat 72 and the two upper seats 66, 86 and the retaining ring is applied. Handling the subassembly will not affect the inherent calibration provided by the low rate springs which will hold their characteristics over a long life. Normally, trying to assemble comparable springs into a pressure switch is very tricky at best. But, with this arrangement the assembly time and, therefore, the cost of assembly is greatly reduced.

The terminal mounting is simple and accurate. Thus, the fixed end 52 of the switch 48 is connected by rivet 96 to the support 92 bent at right angles to the terminal 94. The terminal includes a long connector 98 which projects through the slot 100 in the upper housing 14 to extend beyond the body. In its mounted position the terminal shoulders 102 engage the flat surface 104 inside the upper housing 14. The shoulders 102 are held between the flat surface 104 and the ribs 106 on member 12 to retain the terminal in a precise location. Terminal 64 is similarly mounted. In each case the ribs 106 on the upper surface of the partition 12 engage the shoulders on the main body of the terminals while the surface 104 engages the shoulders to fix the terminals in location. With this arrangement, given the precision of stamping the terminals and of molding the parts, the terminals are precisely fixed in the housing and the contact spacing is correct and the anchor point of the switch blade is accurate. This factor coupled with the novel cold formed polyimide diaphragm and the precise positioning of the springs on the actuator make it possible to have precise trip and reset pressure points without any calibration of the finished assembly.

We claim:

1. In a pressure switch of the type having a housing in which a diaphragm is mounted for response to pressure in a chamber to move a switch actuator mounted in and guided by a recess in the housing, the improvement comprising;

a pair of springs mounted on the actuator, each spring being compressed between a seat fixed on the actuator and an associated separate seat slidably mounted on the actuator, an associated separate limit stop on the actuator for each of the slidable seats, shoulder means in the recess engaged by one of the sliding seats so actuator movement is opposed by the force of said one spring, said one seat being operative to be engaged by the other sliding seat at a given point in the actuator travel to prevent further movement of said other seat whereby continued travel of the actuator with increasing pressure is opposed by the combined force of both springs, the switch being actuated from a first position to a second position after both springs have become operative to oppose the pressure in the chamber and the switch being actuated from the second position to the first position only after the seat associated with said other spring has reengaged its associated limit stop.

2. A pressure switch according to claim 1 in which both springs are captured on the actuator between said fixed seat and their respective sliding seats.

3. A pressure switch according to claim 2 in which the housing has upper and lower parts separated by a partition having a central opening, a diaphragm pad resting on top of the diaphragm and having a central boss projecting through and guided by the central opening, a tubular recess in the upper housing part, said actuator being connected to said boss and extending into and being guided by said recess.

4. A pressure switch according to claim 3 including a pair of terminals each of which includes a portion engaging and located by said partition and said upper housing part and a connector portion projecting through the upper housing part, each terminal including a portion supporting an electrical contact in the case of one terminal and a switch blade in the case of the other terminal.

5. A pressure switch having upper and lower parts with an intermediate part forming a partition therebetween, a diaphragm between the lower part and the partition to define a chamber below the diaphragm, a conduit for introducing pressure variations to said chamber, a diaphragm pad between the diaphragm and the partition and having a boss projecting through and guided by the partition, said upper housing part including a tubular guide in alignment with said boss, an actuator and spring assembly mounted in said guide with the upper end of the actuator guided by the upper end of the guide and the lower end of the actuator connected to said boss, a spring seat fixed on the lower end of the actuator, vertically spaced shoulders on the upper portion of the actuator, a first annular seat slideably mounted on the actuator and dimensioned to seat on the upper of the two shoulders, a reset spring compressed between said seats, a second annular seat slidably mounted on the actuator and dimensioned to seat on the lower of the two shoulders and having an outside diameter greater than the inside diameter of said first seat, a trip spring compressed between said second seat and the fixed seat, an inside shoulder in said guide, said first seat engaging the inside shoulder at all times so pressure in the chamber acting on the diaphragm and the actuator is opposed by the reset spring, said second seat engaging said first seat during upward movement of the actuator so continued actuator movement is opposed by both springs, said upper housing part defining a switch chamber at its lower end, a switch mounted in said switch chamber between the partition and the upper housing part, said actuator engaging the switch to operate the switch between first and second positions, said switch being actuated to said second position only after actuator movement is opposed by both springs and being returned to said first position only after actuator movement is opposed only by the reset spring.

6. A pressure switch according to claim 5 in which the diaphragm is thin plastic having a central portion pre-formed to a domed configuration, the plastic being impermeable to refrigerant and oil, the perimeter of the diaphragm being captured between said partition and the lower housing part, and an O-ring mounted in the lower housing part and bearing against the diaphragm to seal against leakage from the chamber.

7. A pressure switch according to claim 5 including two terminals each of which has an enlarged body engaged by the partition and the upper part of the housing and an elongated terminal portion coplanar with said body and extending through the upper part of the housing, each of the terminals having a support bent from the body, the blade of said switch being mounted on the support of one said terminals and extending towards and over the support of the other of said terminals, and a contact mounted on said other terminal support.

* * * * *